United States Patent [19]

Theurer et al.

[11] 4,270,456

[45] Jun. 2, 1981

[54] MOBILE APPARATUS FOR RECEIVING AND LAYING AN ASSEMBLED TRACK SECTION

[75] Inventors: Josef Theurer, Vienna; Friedrich Oellerer, Linz, both of Austria

[73] Assignee: Franz Plasser Bahnbaumaschinen Industriegesellschaft m.b.H., Vienna, Austria

[21] Appl. No.: 895,271

[22] Filed: Apr. 10, 1978

[30] Foreign Application Priority Data

Apr. 21, 1977 [AT] Austria ..... 2808/77
Jun. 30, 1977 [AT] Austria ..... 4681/77

[51] Int. Cl.[3] ..... E01B 29/02

[52] U.S. Cl. ..... 104/3; 104/2; 212/189; 212/205; 212/212; 414/339; 414/342; 414/345

[58] Field of Search ..... 104/2, 3, 4, 5; 212/13, 212/14, 18, 63, 145, 12, 15, 16, 189, 205, 212; 414/339, 342, 345, 786; 29/429

[56] References Cited

U.S. PATENT DOCUMENTS

| | | | |
|---|---|---|---|
| 989,931 | 4/1911 | Smith et al. | 104/3 |
| 1,821,340 | 9/1931 | Guilbert et al. | 104/3 |
| 2,458,050 | 1/1949 | Blondelle | 104/5 |
| 2,696,791 | 12/1954 | Boulard | 104/3 |
| 2,794,557 | 6/1957 | Vero | 212/63 |
| 4,046,077 | 9/1977 | Theurer et al. | 104/2 |
| 4,094,249 | 6/1978 | Theurer et al. | 104/6 |

FOREIGN PATENT DOCUMENTS

| | | | |
|---|---|---|---|
| 304711 | 4/1918 | Fed. Rep. of Germany | 212/15 |
| 487703 | 12/1929 | Fed. Rep. of Germany | 104/3 |
| 1053544 | 3/1959 | Fed. Rep. of Germany | 104/5 |
| 2410718 | 9/1975 | Fed. Rep. of Germany | 104/2 |
| 720472 | 12/1954 | United Kingdom | 104/4 |
| 1173791 | 12/1969 | United Kingdom | 212/145 |

*Primary Examiner*—Randolph A. Reese
*Attorney, Agent, or Firm*—Kurt Kelman

[57] ABSTRACT

Assembled track sections are replaced with a mobile apparatus moving along the track and having an elongated overhead girder extending above a transport vehicle or vehicles and projecting beyond an end thereof. A guide track extends in a transport plane along the girder and a trolley is mounted on the guide track for movement therealong, the trolley including a vertically adjustable hoist for lifting and lowering a respective track section and for conveying it along the guide track in the transport plane. Gantry supports for the girder project laterally beyond the longitudinally extending sides of the vehicle(s) for leaving therebetween a transverse space for permitting the passage of an assembled track switch section therethrough, the gantry supports including supports mounting the girder on the vehicle(s) and vertically adjustably supporting the projecting part of the girder on the ballast bed. The gantry supports are laterally adjustable transversely to the elongation of the girder and in a plane substantially parallel to the transport plane.

10 Claims, 10 Drawing Figures

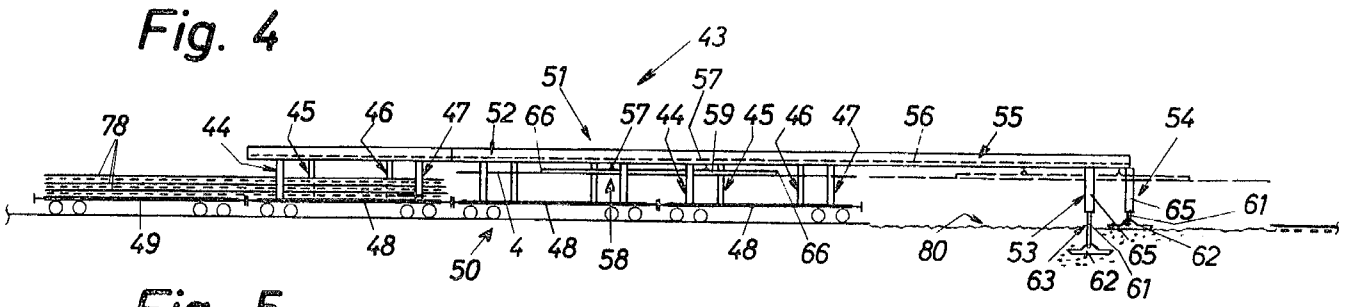
Fig. 4
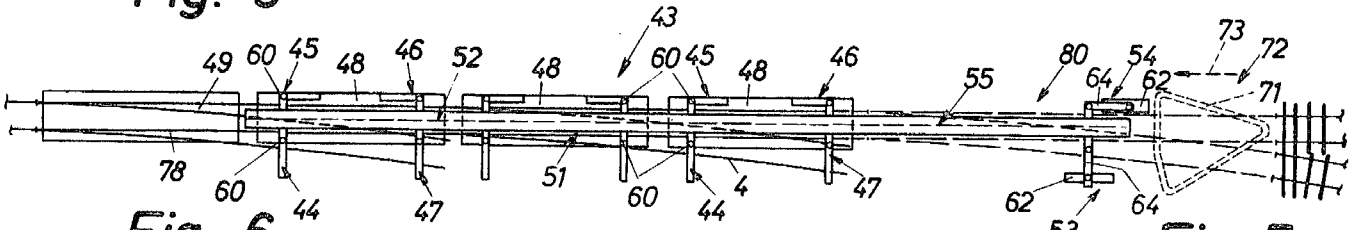
Fig. 5
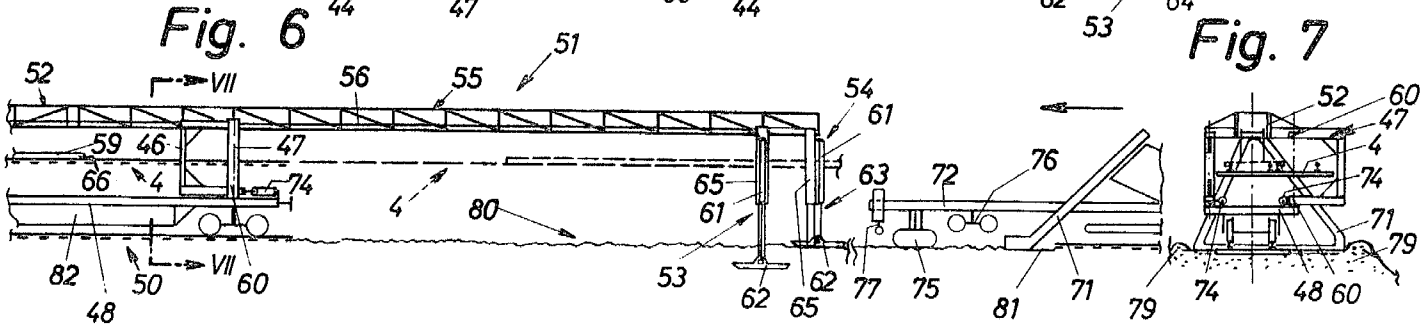
Fig. 6
Fig. 7

MOBILE APPARATUS FOR RECEIVING AND LAYING AN ASSEMBLED TRACK SECTION

The present invention relates to improvements in a mobile apparatus for receiving and laying an assembled track section consisting of rails fastened to ties, and more particularly, switch track sections, entire switches and like bulky track structures.

Apparatus of this type comprise a transport vehicle movable along a track supported on a ballast bed, the vehicle having respective ends and longitudinally extending sides between the ends, an elongated overhead girder extending above the vehicle and having longitudinally extending sides, the girder including a carrier arm projecting beyond one of the vehicle ends, a guide track extending in a transport plane along the overhead girder, a trolley mounted on the guide track for movement therealong and including a vertically adjustable hoisting means for lifting and lowering a respective track section and for conveying it along the guide track in the transport plane, and gantry supports for the overhead girder for mounting the girder on the vehicle and for vertically adjustably supporting the carrier arm on the ballast bed.

An apparatus of this general type has been disclosed in U.S. Pat. No. 2,696,791, dated Dec. 14, 1954 but this apparatus cannot be used with track switch sections because of their widths. In addition, when this known apparatus is in use for laying assembled track sections, traffic in an adjacent track is obstructed.

Offenlegungsschrift (Published German Application) No. 2,410,718 discloses a mobile apparatus for receiving and laying assembled track sections, which comprises a bridge frame spanning the entire working site and being supported at both ends of the working site by mobile carriages capable of running either on or off the track. In this apparatus, access to the working site is blocked from both ends by the support carriages of the apparatus frame. Furthermore, the spaced supports for the heavy apparatus frame subject the track or ballast bed on which the support carriages rest to extremely heavy loads, causing damage to the track rails or ballast bed.

It is the primary object of this invention to provide an apparatus of the indicated type which assures a high efficiency, particularly in replacing track switch sections, while reducing interference with traffic in neighboring tracks to a minimum.

The above and other objects of the invention are accomplished in an apparatus of the hereinabove described type with gantry supports for the overhead girder laterally projecting beyond the longitudinally extending sides for leaving therebetween a space extending transversely to the track for permitting the passage of an assembled track switch section therethrough, the gantry supports including supports connecting the overhead girder to the vehicle for mounting the girder on the vehicle and vertically adjustable support means for supporting the carrier arm on the ballast bed, the girder bridging the gantry supports, and means for laterally adjusting the gantry supports substantially transversely to the elongation of the overhead girders and in a plane substantially parallel to the transport plane.

Such an apparatus provides a method of replacing an old assembled track section with a new assembled track section in a working site, which comprises moving a train comprising a plurality of the transport vehicle along the track to the working site, the train having a forward end adjacent the working site and a length sufficient to accommodate at least two assembled track sections, storing a new assembled track section on the train in a rear region thereof longitudinally spaced from the forward end, selectively transversely adjusting respective ones of the gantry supports as the train is moved to the working site to avoid lateral obstacles in the path of the gantry supports, vertically adjusting the support means intermediate the ends of the old track section in the working site and laterally thereof until the support means suports the carrier arm on the ballast bed, transversely adjusting the gantry supports until the transverse space therebetween permits passage of the old track section therethrough, lifting the old track section with the hoisting means, conveying the old track section along the guide track through the gantry supports, and lowering the old track section onto the train in a forward region thereof extending longitudinally between the rear region and the forward end to store the old track section on the train, treating the ballast in the working site by cleaning and/or smoothing the ballast after the old track section has been lifted and as it is conveyed, lowered and stored, and lifting the new track section with the hoisting means, conveying the new track section along the guide track through the gantry supports, and lowering the new track section onto the treated ballast in the working site.

According to a preferred embodiment of this invention, the vertically adjustable support means supports an outer end of the carrier arm on the ballast bed and the apparatus further comprises a pivot bearing mounting the overhead girder on the transport vehicle in the region of the gantry supports connected with the vehicle and the girder, and a power drive for pivoting the overhead girder about a pivot axis extending substantially vertically to the transport plane in a plane substantially parallel to the transport plane and transversely to the direction of elongation of the vehicle.

The construction of the mobile apparatus in accordance with the invention assures in an unexpectedly simple and advantageous manner not only a high operating efficiency, particularly in handling oversized and bulky assembled track sections, such as track sections of extra width and track switches, without necessitating closing of the neighboring track to through traffic. Furthermore, the transverse adjustment of the gantry supports to adapt the space therebetween to the width of the track sections holds the working width of the apparatus always to a minimum, which often facilitates or expedites the movement of the mobile apparatus along the track. This adjustability of the operating width of the apparatus determined by the lateral position of the gantry supports in relation to the longitudinally extending sides of the transport vehicle(s) makes it possible always to move within a given transverse space available so that lateral obstacles along the right of way, such as poles or masts, may be avoided as the apparatus moves from site to site. Furthermore, since one end of the working site is always accessible, the ballast bed may be treated, i.e. the ballast may be cleaned and/or smoothed, immediately after the old track section is lifted from the site so that the entire replacement operation proceeds rapidly in a single working cycle. With relatively simple means, the invention provides a universally useful mobile apparatus for transporting and laying oversized assembled track sections. The method of the present invention makes possible a complete track renewal in a single operating cycle without interfering with parallel traffic and in a minimum of time, the ballast treatment being integrated with the track section replacement so as to avoid losses of time and to assure an exact and rapid placement of the new track section.

The above and other objects, advantages and features of this invention will become more apparent from the following detailed description of certain now preferred embodiments thereof, taken in conjunction with the accompanying generally schematic drawing wherein FIG. 1 is a side elevational view of one embodiment of a mobile apparatus for receiving and laying an assembled track section, the apparatus being shown during operation and in the stage of lifting an old track section in a working site;

FIG. 4 is a side elevational view showing another embodiment of the mobile apparatus;

FIG. 5 is a top view of FIG. 4;

FIG. 6 shows a portion of the apparatus of FIG. 4 on an enlarged scale, as well as adjacent ballast treating apparatus;

FIG. 7 is a transverse section along line VII—VII of FIG. 6;

Figures 1, 2, 3:
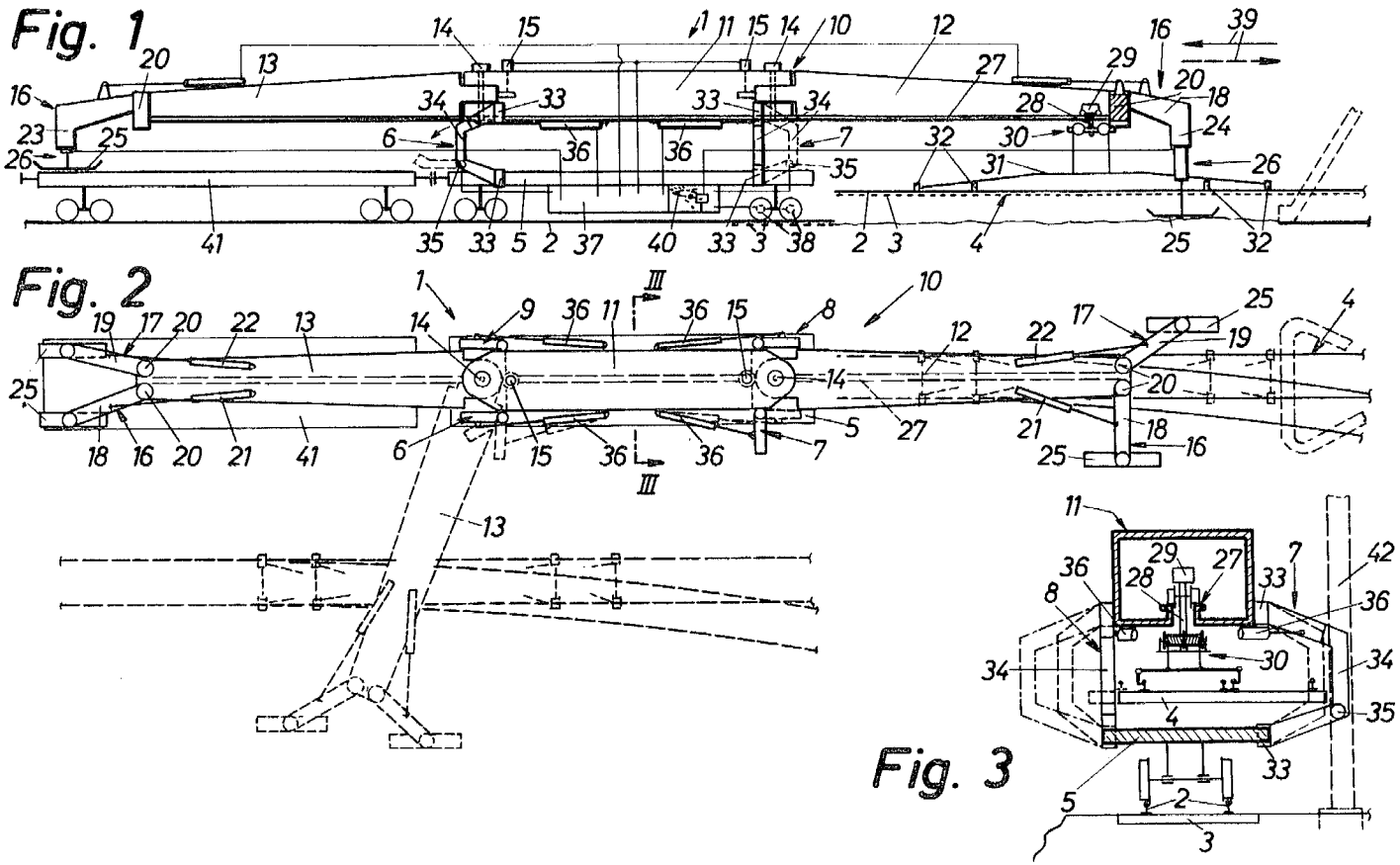
FIG. 2 is a top view of the apparatus of FIG. 1, the rear carrier arm of the overhead girder being shown in broken lines in a selected pivotal position for receiving or laying a track section laterally of the track.
FIG. 3 is a transverse section along line III—III of FIG. 2 illustrating details of the main girder carrier, associated gantry supports, and the hoisting means.

Referring now the the drawing and first to FIGS. 1 and 2, there is shown mobile apparatus 1 for receiving and laying assembled track section 4 consisting of rails 2 and ties 3, for example a track switch section. The illustrated apparatus comprises transport vehicle 5 movable along a track supported on a ballast bed. An elongated overhead girder 10 extends above the vehicle. In the embodiment of FIGS. 1 and 2, girder 10 is comprised of main carrier 11 extending substantially along the entire length of the vehicle and two carrier arms 12 and 13 projecting beyond respective ends of vehicle 5. Guide track 27 extends in a transport plane along the overhead girder and trolley 28 is mounted on the guide track for movement therealong. The trolley includes vertically adjustable hoisting means 30 for lifting and lowering track section 4 and for conveying the track section along guide track 27 in the transport plane. Gantry supports for the overhead girder include supports 6, 7, 8 and 9 connected with vehicle 5 and girder 10 for mounting the girder on the vehicle and vertically adjustable support means 16 for supporting the carrier arms on the ballast bed, the girder bridging the gantry supports. Respective ones of the gantry supports are disposed at respective ends of vehicle 5 and at respective outer ends of projecting carrier arms 12 and 13. The carrier arms are pivotal in the transport plane and pivot means 14 mounts the inner ends of the carrier arms on main carrier 11 about an axis extending substantially vertically to the transport plane. In the preferred illustrated embodiment, the main carrier and the two carrier arms are arranged symmetrically with respect to a median plane of symmetry extending transversely and vertically to the vehicle, i.e. they are mirror-symmetric.

With this embodiment, it is possible to use the mobile apparatus selectively for receiving and/or laying assembled track sections at either end of the vehicle, one carrier arm serving to receive or lay the track section while the other carrier arm is used to convey a new track section stored on a rear vehicle 41 coupled to vehicle 5. The mirror-symmetrical arrangement makes the structure simple and also assures a uniform load on the main carrier and carrier arms. In this manner, the apparatus may be used universally in both directions.

Pivot means 14 may usefully comprise a pinion coaxial with the pivoting axis at the inner end of each carrier arm and a rack engaging the pinion and mounted on main carrier 11, the rack being driven by a suitable drive 15, for instance an electric motor or a hydraulic drive, for pivoting the carrier arm.

Gantry supports 16, 17 are disposed at the outer ends of carrier arms 12 and 13 and, like gantry supports 6 to 8, these supports, too, are adjustable transversely to the elongation of the overhead girder and the track, the illustrated adjustment being by pivoting although the gantry supports may also be adjusted transversely in any other suitable manner. As shown, the gantry supports 16, 17 disposed to support the outer carrier arm ends spaced from the vehicle ends whence the carrier arms project include arm member 18, 19 having two ends and vertical support member 23, 24 extending from one of the arm member ends, a substantially vertical pivot 20 mounting the other arm member end on the outer carrier arm end whereby the gantry supports 16, 17 may be pivoted about vertical pivots 20 independently of each other by hydraulic drives 21, 22, one end of which is linked to arm members 18, 19 while their other end is linked to carrier arms 12 and 13. The vertically adjustable support means 26 for supporting the carrier arms on the ballast bed are constituted in the illustrated embodiment by support shoes 25 vertically adjustably supporting vertical support members 23, 24.

As best shown in FIG. 3, trolley 28 is self-propelled, drive motor 29 moving the trolley along guide track 27. The trolley carries hoist 30 on which is vertically movably mounted elongated carrier beam 31 extending in the direction of the elongation of girder 10 and the track, the carrier beam mounting a plurality of gripping devices 32 spaced along the length of the carrier beam and capable of gripping assembled track section 4. The use of an elongated carrier beam protects the assembled track section from undue flexing forces while they are carrier by the hoist. This is of particular importance in handling and laying very heavy switch track sections.

Gantry supports 6, 7, 8 and 9 are each comprised of two support arms respectively connected to vehicle 5 and girder 10, and vertical support member 34 having two ends. Pivots 33 extending vertically to the transport plane mount the inner ends of the gantry support arms on the vehicle and main carrier 11 of the girder for adjusting the gantry supports transversely to the elongation of the girder and in a plane substantially parallel to the transport plane. A hydraulic drive 36 is connected to one of the gantry support arms for adjusting the gantry supports transversely about pivots 33. One end of support members 34 is detachably connected to the outer end of one of the support arms, for instance by means of bolt, screw or bayonet joint connections, while the other support member end is pivotally connected to the outer end of the other support arms by means of pivot pin 35 extending horizontally whereby the vertical support members 34 may be pivoted away from the longitudinally extending sides of vehicle 5, as shown in broken lines in connection with gantry support 6 in FIG. 1.

According to a preferred feature and as described hereinabove, each of the gantry supports, i.e. the gantry supports on opposite longitudinal sides of the girder as well as those spaced from each other along the same longitudinal sides, are adjustable transversely independently of each other. In this manner, the apparatus and, more particularly, its operating width may be adapted to different operating conditions to work on right or left switches, for example, and also to avoid any obstacles, such as poles or masts 42, along the right of way when the apparatus moves along the track, various lateral positions of the gantry supports being shown in broken lines in FIG. 3, as these supports are pivoted inwardly. This is of particular advantage around railroad stations where neighboring tracks may be found alternately on the right and on the left and where it is not desired to interfere with traffic on such neighboring tracks while the apparatus is in operation. The lateral adjustment of gantry supports 16 and 17 makes it possible to adjust the transverse spacing between these supports and to engage desired portions of the ballast bed so that a switch section may pass therebetween with its wider end so that the projecting carrier arm need not reach over the entire length of the working site. The vertically adjustable support means makes it possible to engage ballast bed portions of different elevation, or to engage the flat bed of an auxiliary vehicle 41, as illustrated in FIG. 1.

In the embodiment of FIGS. 1 and 3, the apparatus is self-propelled, vehicle 5 being driven along the track by motor means 38 in the directions indicated by arrows 39. The vehicle carries a central power source 37 which may be a hydraulic fluid tank if the apparatus is equipped with hydraulically-operated drives all receiving their power from the central source. Central operator's cab 40 is mounted in the range of central power source 37 and includes a control panel to which all drives are operatively connected for actuating each of the drives from the panel, including motors 38. This central control of all operations from cab 40 avoids the need for operating personnel moving along the track, which may be quite dangerous, and also facilitates adaptation of all apparatus components to specific operating conditions. Since vehicle 5 is self-propelled, its positioning at the working site is greatly facilitated.

The operation of the apparatus will partly be obvious from the above description of its structure and will be further elucidated in connection with FIG. 2.

Mobile apparatus 1 is moved to the working site until the forward end thereof is adjacent thereto and carrier arm 12 of girder 10 projects beyond the forward end into the working site. During the movement of the apparatus to the working site, pivotal arms 18, 19 of gantry supports 16, 17 at the outer end of carrier arm 12 extend parallel to the elongation of girder 10 and support means 26 is raised. At the same time, support means 26 of the gantry supports at the outer end of rear carrier arm 13 rest on the flat bed or rear transport vehicle 41 coupled to vehicle 5. When the apparatus is positioned at the working site, pivotal arms 18, 19 of the forward gantry supports for carrier arm 12 are transversely pivoted by operating hydraulic drives 21, 22 until support shoes 25 are positioned laterally of old track section 4 and intermediate the ends thereof, whereupon support means 26 are lowered to support carrier arm 12 on the ballast bed. The transverse space between gantry supports 16 and 17 resting on the ballast bed is sufficient to permit passage of track section 4 therethrough. The track section is now gripped by devices 32 of carrier beam 31, raised by hoist 30 and moved rearwardly along guide track 27 in the direction of vehicles 5 and 41. To enable the assembled track section to pass through gantry supports 6, 7, 8, 9, the gantry supports on at least one longitudinal side, i.e. gantry supports 6 and 7 in FIG. 2, are transversely pivoted by drives 36. As the old assembled track section is lifted, conveyed and lowered onto vehicle 41 or laterally removed in a manner to be explained hereinbelow, the ballast in the working site is treated in a conventional manner, for instance by cleaning and/or smoothing the ballast by means of a ballast excavating chain 71 shown sketchily in broken lines in FIGS. 1 and 2 since ballast cleaning machines are well known. As is clear from the full-line position of gantry support 7 in FIG. 3, the transverse space between the gantry supports is sufficient to permit track section 4 to pass therethrough.

After the old track section has been lifted and received on apparatus 1, support means 25 are raised off the ballast bed and the apparatus may be moved to a site where the track section is repaired and/or dissassembled. As again shown in FIG. 3, when the apparatus encounters obstacles 42 along the route, respective ones of the gantry supports may be independently or in unison transversely adjusted into lateral positions indicated in broken lines whereby the suspended track section between the gantry supports is also transversely adjusted to avoid the obstacles. All of these adjustments may be readily controlled from cab 40.

As shown in broken lines in FIG. 2, once the apparatus has arrived at its destination, drive 15 is operated to pivot carrier arm 13 to one side, vertical support members 34 of gantry supports 6 and 7 are opened by pivoting them down about pivot pins 35, and trolley 28 is moved along the guide track in carrier arm 13. The hoist may then be lowered to place track section 4 into the indicated position next to vehicles 5 and 41. Thus, no fixed crane is required to unload the track section and, after the old track section has been unloaded, the procedure may be reversed to load a new track section on apparatus 1 and to lay it at the working site. The entire renewal operation proceeds in a single operating cycle without interfering with parallel traffic and in the shortest possible time. The ballast at the working site can be treated immediately after the old track section has been removed, thus further shortening the operating time. The lateral movement of the carrier arms makes it possible to operate in regions laterally adjacent the operating track and the apparatus may thus be used to receive and/or lay track sections in neighboring tracks.

In the embodiment of FIGS. 4 and 5, mobile apparatus 43 comprises a plurality of transport vehicles 48 and 49 coupled together to form a train 50 movable along the track, the length of the train being sufficient to accommodate at least two assembled track switch sections placed on the train side-by-side in the direction of train elongation. This has the advantage that new track sections 78 may be stored on rear vehicle 49 and there is still room enough left on the train, i.e. vehicle 48, for receiving old track sections removed from a working site. Such an apparatus need not be moved away from the working site after an old track section has been picked up but may remain on the site while the new track section is laid.

In this embodiment, overhead girder 51 is constituted by a spatial framework, which imparts added strength thereto. The girder is comprised of main carrier 52 having a length exceeding that of one of the assembled track sections and carrier arm 55 having a length not exceeding that of one track section, arm 55 projecting beyond one end of train 50. Gantry supports 44, 45, 46 and 47 connect vehicles 48, 49 and main carrier 52 for mounting girder 51 on the train. Gantry supports 53, 54 vertically adjustably support carrier arm 55 on the ballast bed. Guide track 56 for trolley 57 passes along the entire overhead girder comprised of main carrier 52 and projecting arm 55 and hoist 58 is mounted on the trolley and carries elongated carrier beam 59, all in a manner more fully described in connection with the embodiment of FIGS. 1 to 3.

As can be seen from FIG. 5, gantry supports 44 to 47 are pivotal about axes 60 extending vertically to the transport plane and transversely to the elongation of the overhead girder. When the gantry supports on at least one longitudinal side are pivoted outwardly, switch track sections may readily pass between the supports disposed at respective longitudinal sides. Gantry supports 53 and 54 are similarly transversely displaceable so that vertically adjustable support shoes 62 may be lowered onto the ballast bed by hydraulic drives 61 at respective lateral sides of the track section in the working site in a manner more fully described hereinabove in connection with FIGS. 1 to 3. Also as in that embodiment, elongated carrier beam 59 has gripping devices 66 for holding the track section as it is lifted by hoist 58 and conveyed by trolley 57. Furthermore, FIG. 5 also shows ballast excavating chain 71 of a switch ballast cleaning machine 72 for treating the ballast at the working site after the old track section has been removed in the direction of arrow 73.

As best shown in the enlarged view of FIG. 6, guide track 56 extends along the lower boom of lattice girder 51. Transverse adjustment of gantry supports 44 to 47 is effected by hydraulic drives 74 anchored to the flat beds of the transport vehicles for pivoting the supports. Switch ballast cleaning machine 72 is shown to run selectively on track-laying bogie 75 enabling the machine to move on the ballast bed and retractable wheeled undercarriage 76 enabling the machine to move on a track. The machine frame of the ballast cleaning machine also has auxiliary undercarriage 77. In position, the ballast cleaning chain 71 excavates the ballast and moves it to a cleaning screen, the cleaned ballast being stored next to the track for being redistributed in the ballast bed after the new track section has been laid on the smoothed bed. All of this is known and forms no part of the present invention.

FIG. 7 illustrates gantry support 47 when pivoted outwardly by hydraulic drive 74 to accommodate assembled track section 4 between laterally aligned gantry supports. It is also seen in this figure that the excavating length of ballast cleaning chain 71 extends over the entire width of the switch, the stored, clean ballast at the side of the site being designated 79.

The train of FIGS. 4 to 7 operates in the following manner:

One or more new assembled track sections 78 are stored on rear transport vehicle 48 and the train is moved by a locomotive or is self-propelled to the working site, during which time gantry supports 44 to 47, at least on vehicle 48, are so adjusted transversely that track sections 78 fit therebetween. If the train moves along a track next to which there is another track carrying traffic, only those gantry supports are transversely adjusted which are disposed along the longitudinal side of the vehicle facing away from the neighboring track. In this way, there will be no interference with any passing traffic on the neighboring track. As has been indicated hereinabove in the description of FIGS. 1 to 3, any obstacles encountered along the travel route may be readily avoided by swinging respective gantry supports inwardly since, in most instances, the width of switch sections exceeds the available lateral space without moving the switch sections transversely.

After the train arrives at the working site, hydraulic drives 61 are operated to lower support means 63 and rest shoes 62 on the ballast bed whereby the outer end of carrier arm 55 is supported thereon, gantry supports 53 and 54 having been transversely adjusted so that support shoes 62 rest on the ballast bed at the lateral sides of track section 4. In the same manner as described hereinabove, the old track section is then lifted and conveyed back, gantry supports 44 to 47 being laterally displaced to permit the old track section to pass therebetween, and the old track section is then lowered onto transport vehicles 48 where it is stored. The ballast at working site 80 is now suitably treated and the cleaned ballast is either stored laterally of the site or at least partially returned thereto and smoothed to prepare the bed for a new track section 78 conveyed forwardly along the guide track 56 while the ballast bed is being treated to form smooth bed 81. The entire renewal operation proceeds in a single operating cycle. After the renewal at one working site has been completed, support shoes 62 are raised off the ballast bed and train 50 may be moved to the next site.

As shown in FIG. 6, the train has a central power source 82 from which all operating drives may be supplied, as in the previously described embodiment. As has been indicated, the transverse adjustment or displacement of the gantry supports may be effected by a pivotal movement but it may also be carried out by a straight-line transverse movement, for instance with the use of telescoping parts.

Also, the gantry supports at the outer ends of the carrier arms or arms may be pivoted about a common axis extending substantially vertically to the transport plane for track sections 4. All the transverse movements of the gantry supports may be centrally controlled in unison or individually so that only those supports are displaced which need be moved to avoid a lateral obstacle while other supports remain in place. Obviously, any type of lifting means may be used instead of the illustrated hoist and the displacement drives for the gantry supports may also be of any suitable structure, such as spindle-and-nut drives and the like, hydraulic drives being particularly convenient.

As will be appreciated from the above description and drawing, the gantry supports operates as adjustable clamps wherebetween respective assembled track sections may be held and, when required, laterally moved out of the way of obstacles along the right of way by suitably adjusting respective gantry supports transversely.

The embodiment illustrated in FIGS. 8 to 10 and described hereinbelow has the particular advantage of making it possible to operate with a relatively short apparatus at selected ends thereof so that assembled track sections may be picked up and/or laid at either end. This avoids the need of making use of neighboring tracks for transporting the track sections and thus greatly rationalizes operations.

As in the other embodiments, mobile apparatus 91 is arranged for receiving and laying assembled track section 4 consisting of rails 2 fastened to ties 3. It includes vehicle 95 movable along a track and carrying overhead girder 100 mounted on the vehicle by means of laterally adjustable gantry supports 106, 107, 108 and 109. In this embodiment, the gantry supports connecting the girder to the vehicle are arranged on a pivot bearing 113 and power drive 115 is arranged to pivot the overhead girder about pivot axis 114 extending substantially vertically to the transport plane in a plane substantially parallel to the transport plane and transversely to the direction of elongation of the vehicle. In the illustrated embodiment, the pivot bearing comprises carrier plate or turntable 112 and pinion 116 on the carrier plate, and the power drive comprises a motor means 118 mounted on transport vehicle 95 and rack 117 driven by the motor means and engaging the pinion, gantry supports 106 to 109 being mounted on the carrier plate and connected to main carrier 111 of the overhead girder.

As in the other embodiments, laterally adjustable gantry supports 120, 121, with vertically adjustable support means 122 support an outer end of a projecting carrier arm of the overhead girder on the ballast bed. Also as in the other embodiments, a trolley 123 carrying hoisting means 124 runs along a guide track on the overhead girder.

The illustrated rack-and-pinion drive has the particular advantage of enabling the considerable torsional forces required for pivoting the overhead girder by as much as 180° about axis 114 to be transferred directly from the vehicle to the track. As in the other embodiments, the gantry supports for the projecting girder carrier arm have the advantage of distributing the heavy weight of assembled track sections carried by the girder over the entire length thereof so that it is possible, for instance, to swing the girder to the side of the track to pick up or lay a track section in a neighboring track, if desired. They also avoid a one-sided load on the girder while it is pivoted about axis 114.

Figures 8, 9, 10:
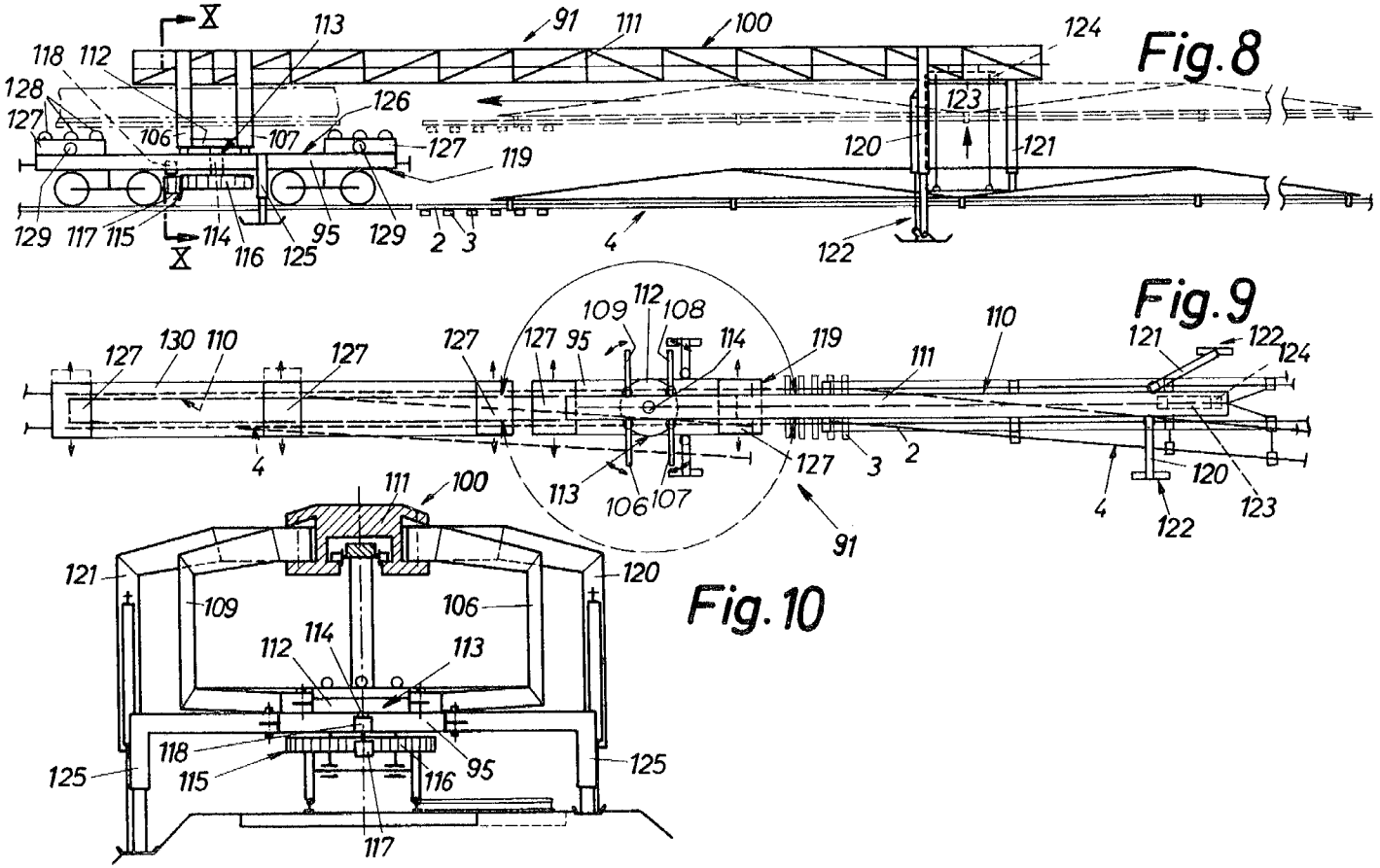
FIG. 8 is a side elevational view illustrating a third embodiment of the mobile apparatus in the stage of lifting an old track section at a working site.
FIG. 9 is a top view of FIG. 8 at a reduced scale, the vehicle carrying the girder being shown coupled to another transport vehicle.
FIG. 10 is an enlarged end view along line X—X of FIG. 8.

As shown in FIG. 8, outwardly pivotal support jacks 125 are mounted in the range of the gantry supports connecting the main carrier of the overhead girder to vehicle 95, the support jacks having shoes for engagement with the ballast.

The main carrier 111 extends from the pivot bearing towards one vehicle end and the length of the carrier arm projecting therebeyond is about half the length of track section 4. The transport vehicle 95 includes a flat bed 126 and platforms 127 are mounted on the flat bed and are adapted to carry a respective track section 4 for displaceably carrying the track section on the vehicle. As best shown in FIG. 9 in connection with auxiliary transport vehicle 130 coupled to vehicle 95, each platform is mounted on the flat beds of the vehicles for displacement in a direction transversely and parallel to the vehicle elongation by means of drives 129. The platforms carry rollers 128 for rolling engagement with track sections supported thereon. In this manner, it is possible to load track sections onto succeeding transport vehicles without any difficulty even if the main carrier of the girder and its supporting vehicle are very short, the displaceable supporting platforms also enabling the track section to be suitably positioned during transport, including lateral displacement of the track section to avoid any obstacle along the right of way. Thus, a single flat bed freight car coupled to the transport vehicle carrying the overhead girder will make it possible to transport a switch track section along a track like any regular train.

FIG. 10 illustrates the gantry supports as well as support jacks 125 in their outwardly pivoted positions, the support jacks being capable of engaging the ballast adjacent the tie ends as well as on the shoulder of the ballast bed. The transverse adjustability of the gantry supports is so selected that the apparatus is capable of receiving and laying switch sections branching off either to the right or to the left.

Apparatus 91 is operated similarly to the operation described hereinabove in connection with the other embodiments of the present invention. The apparatus is moved to the working site with overhead girder 100 pivoted rearwardly as to extend along transport vehicles 95 and 130. On arrival at the working site, support jacks 125 are pivoted outwardly and vertically moved into engagement with the ballast and main carrier 111 of the overhead girder is pivoted into its operating position wherein it projects forwardly of the forward end of vehicle 95. The support jacks are then disengaged and the apparatus is moved forwardly until its forward end 119 is immediately adjacent assembled track section 4. The gantry supports 120, 121 are then sufficiently adjusted laterally that they may rest by means of vertically adjustable supports 122 at respective sides of track section 4. The track section is now lifted and conveyed rearwardly through laterally adjusted gantry supports 106 to 109 and stored on rear vehicle 130. Gantry supports 120 and 121 are then retracted upwardly and inwardly while the apparatus is moved from the site to a place where the track section is stored, the track section on vehicle 130 being laterally displaceable during this movement of the apparatus along the track by means of platforms 127 on which it rests.

As has been shown in connection with FIG. 2, the old track section may be deposited at its ultimate destination adjacent to apparatus 95 by suitable pivoting of the overhead girder about axis 114.

What is claimed is:

1. A mobile apparatus for receiving and laying an assembled track section consisting of rails fastened to ties, which comprises (a) a transport vehicle movable along a track supported on a ballast bed, the vehicle having respective ends and longitudinally extending sides between the ends, (b) an elongated overhead girder extending above the vehicle and having longitudinally extending sides, the girder defining a transport plane and being comprised of (1) a main carrier extending substantially along the entire length of the vehicle and (2) two carrier arms projecting beyond respective ones of the vehicle ends, the carrier arms having inner and outer ends and being pivotal in the transport plane, (c) means pivotally mounting the inner ends of the carrier arms on the main carrier so as to avoid obstructing a neighboring track in a curve when a respective one of the carrier arms projects into the neighboring track, (d) power drive means for pivoting the carrier arms in the transport plane, (e) a guide track extending in the transport plane along the overhead girder, (f) a trolley mounted on the guide track for movement therealong, the trolley including (1) vertically adjustable hoisting means for lifting and lowering a respective one of the assembled track sections and for conveying the assembled track section along the guide track in the transport plane (g) gantry supports for the overhead girder and adjustable between selected lateral positions respectively projecting beyong the longitudinally extending sides and leaving therebetween a wide enough space extending transversely to the track to permit the passage of an assembled track switch section therethrough, respective ones of the gantry supports being disposed at the respective vehicle ends and at the respective outer ends of the projecting carrier arms, (1) the gantry supports including supports connecting the overhead girder to the vehicle for mounting the girder on the vehicle and vertically adjustable support means, the girder bridging the gantry supports and each support means including an arm member having two ends, a vertical support member extending from one of the arm member ends, means vertically adjustably supporting the vertical support member, and a substantially vertical pivot mounting the other arm member end on the outer carrier arm end, and (h) means for laterally adjusting each one of the gantry supports independently substantially transversely to the elongation of the overhead girder and in a plane substantially parallel to the transport plane into the selected lateral positions.

2. The mobile apparatus of claim 1, wherein the adjusting means is arranged to pivot the gantry supports.

3. The mobile apparatus of claim 1, wherein the main carrier and the two carrier arms are arranged symmetrically with respect to a median plane of symmetry extending transversely and vertically to the vehicle.

4. The mobile apparatus of claim 1, further comprising another transport vehicle movable along the track and coupled to one of the ends of the first-named transport vehicle, one of the carrier arms projecting beyond the one transport vehicle end over the other transport vehicle, one of the vertically adjustable support means supporting the outer end of the one carrier arm on the other transport vehicle and the other vertically adjustable support means supporting the outer end of the other carrier arm on the ballast bed.

5. A mobile apparatus for receiving and laying an assembled track section consisting of rails fastened to ties, which comprises (a) a transport vehicle movable along a track supported on a ballast bed, the vehicle having respective ends and longitudinally extending sides between the ends, (b) an elongated overhead girder extending above the vehicle and having longitudinally extending sides, the girder defining a transport plane and being comprised of (1) a main carrier extending substantially along the entire length of the vehicle and (2) two carrier arms projecting beyond respective ones of the vehicle ends, the carrier arms having inner and outer ends and being pivotal in the transport plane, (c) means pivotally mounting the inner ends of the carrier arms on the main carrier, (d) power drive means for pivoting the carrier arms in the transport plane, (e) a guide track extending in the transport plane along the overhead girder, (f) a trolley mounted on the guide track for movement therealong, the trolley including (1) vertically adjustable hoisting means for lifting and lowering a respective one of the assembled track sections and for conveying the assembled track section along the guide track in the transport plane, (g) gantry supports for the overhead girder adjustable between selected lateral positions respectively projecting beyond the longitudinally extending sides and leaving therebetween a wide enough space extending transversely to the track to permit the passage of an assembled track switch section therethrough, respective ones of the gantry supports being disposed at the respective vehicle ends and at the respective outer ends of the projecting carrier arms, (1) the gantry supports including supports connecting the overhead girder to the vehicle for mounting the girder on the vehicle, each support being comprised of two support arms respectively connected to the vehicle and the girder and of a vertical support member having two ends, one of the support member ends being detachably connected to one of the support arms and the other support member end being pivotally connected to the other support arm whereby the vertical support members may be pivoted towards and away from the longitudinally extending sides of the vehicle, and vertically adjustable support means for supporting the outer ends of the carrier arms, the girder bridging the gantry supports, and (h) means for laterally adjusting each one of the gantry supports independently substantially transversely to the elongation of the overhead girder and in a plane substantially parallel to the transport plane into the selected lateral positions.

6. A mobile apparatus for receiving and laying an assembled track section consisting of rails fastened to ties, which comprises (a) a transport vehicle movable along a track supported on a ballast bed, the vehicle having respective ends and longitudinally extending sides between the ends, (b) an elongated overhead girder extending above the vehicle and having longitudinally extending sides, the girder including (1) a carrier arm projecting beyond one of the vehicle ends, (c) a guide track extending in a transport plane along the overhead girder, (d) a trolley mounted on the guide track for movement therealong, the trolley including (1) vertically adjustable hoisting means for lifting and lowering a respective one of the assembled track sections and for conveying the assembled track section along the guide track in the transport plane, (e) gantry supports for the overhead girder adjustable between selected lateral positions respectively projecting beyond the longitudinally extending sides and leaving therebetween a wide enough space extending transversely to the track to permit the passage of an assembled track switch section therethrough, (1) the gantry supports including supports connecting the overhead girder to the vehicle for mounting the girder on the vehicle and vertically adjustable support means for supporting an outer end of the carrier arm on the ballast bed, the girder bridging the gantry supports, (f) support jacks in the range of the gantry supports connecting the girder to the vehicle, the support jacks being pivotal from the longitudinally extending sides of the vehicle transversely to the direction ofthe elongation of the vehicle and in a plane substantially parallel to the transport plane, (g) means for laterally adjusting all the gantry supports independently of each other substantially transversely to the elongation of the overhead girder and in a plane substantially parallel to the transport plane into the selected lateral positions, (h) a pivot bearing mounting the overhead girder on the transport vehicle in the region of the supports connecting the overhead girder to the vehicle, and (i) a power drive for pivoting the overhead girder about a pivot axis extending substantially vertically to the transport plane in a plane substantially parallel to the transport plane and transversely to the direction of elongation of the vehicle.

7. The mobile apparatus of claim 6, wherein the pivot bearing comprises a carrier plate and a pinion on the carrier plate, the power drive comprises a motor means mounted on the transport vehicle and a rack driven by the motor means and engaging the pinion, and the gantry supports connecting the girder to the vehicle are arranged on the carrier plate.

8. A mobile apparatus for receiving and laying an assembled track section consisting of rails fastened to ties, which comprises (a) a transport vehicle movable along a track supported on a ballast bed, the vehicle having respective ends and longitudinally extending sides between the ends, the transport vehicle including a flat bed and displaceable platforms mounted on the flat bed and adapted to carry a respective one of the assembled track sections for displaceably carrying the track section on the vehicle, (b) an elongated overhead girder extending above the vehicle and having longitudinally extending sides, the girder including (1) a carrier arm projecting beyond one of the vehicle ends, (c) a guide track extending in a transport plane along the overhead girder, (d) a trolley mounted on the guide track for movement therealong, the trolley including (1) vertically adjustable hoisting means for lifting and lowering a respective one of the assembled track sections and for conveying the assembled track section along the guide track in the transport plane, (e) gantry supports for the overhead girder adjustable between selected lateral positions respectively projecting beyond the longitudinally extending sides and leaving therebetween a wide enough space extending transversely to the track to permit the passage of an assembled track switch section therethrough, (1) the gantry supports including supports connecting the overhead girder to the vehicle for mounting the girder on the vehicle and vertically adjustable support means for supporting an outer end of the carrier arm on the ballast bed, the girder bridging the gantry supports, (f) means for laterally adjusting all the gantry supports independently of each other substantially transversely to the elongation of the overhead girder and in a plane substantially parallel to the transport plane into the selected lateral positions, (g) a pivot bearing mounting the overhead girder on the transport vehicle in the region of the supports connecting the overhead girder to the vehicle, the overhead girder being comprised of a main carrier extending from the pivot bearing towards the one vehicle end and a carrier arm projecting beyond the one vehicle end, the length of the projecting carrier arm being about half the length of the assembled track section, and (h) a power drive for pivoting the overhead girder about a pivot axis extending substantially vertically to the transport plane in a plane substantially parallel to the transport plane and transversely to the direction of elongation of the vehicle.

9. The mobile apparatus of claim 8, further comprising rollers on the platforms for rolling engagement with the assembled track section carried thereon, and drive means for displacing the platforms on the flat bed.

10. The mobile apparatus of claim 8, wherein the pivot bearing comprises a carrier plate and a pinion on the carrier plate, the power drive comprises a motor means mounted on the transport vehicle and a rack driven by the motor means and engaging the pinion, and the gantry supports connecting the girder to the vehicle are arranged on the carrier plate.

* * * * *